US007905266B2

(12) United States Patent
Sugiyama

(10) Patent No.: US 7,905,266 B2
(45) Date of Patent: Mar. 15, 2011

(54) WIRE-GATHERING DEVICE, APPARATUS AND METHOD OF WINDING TAPE UTILIZING SAME

(75) Inventor: Akira Sugiyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 316 days.

(21) Appl. No.: 12/007,233

(22) Filed: Jan. 8, 2008

(65) Prior Publication Data

US 2008/0169042 A1 Jul. 17, 2008

(30) Foreign Application Priority Data

Jan. 12, 2007 (JP) ..... 2007-004143

(51) Int. Cl.
*B21F 9/02* (2006.01)

(52) U.S. Cl. ..... 156/428; 156/425; 156/475; 156/493

(58) Field of Classification Search ..... 156/468, 156/425, 428, 475, 493
See application file for complete search history.

(56) References Cited

U.S. PATENT DOCUMENTS

| | | | | |
|---|---|---|---|---|
| 2,833,438 | A * | 5/1958 | Anderson | 156/468 |
| 3,418,358 | A * | 12/1968 | Sejda | 156/468 |
| 5,355,787 | A * | 10/1994 | Burns et al. | 156/486 |
| 5,875,618 | A * | 3/1999 | Sodies et al. | 156/468 |

FOREIGN PATENT DOCUMENTS

| | | |
|---|---|---|
| DE | 29718961 | 2/1998 |
| EP | 0418176 A1 | 3/1991 |
| EP | 418176 A1 * | 3/1991 |
| JP | 07-215599 | 8/1995 |
| JP | 09-183413 | 7/1997 |

OTHER PUBLICATIONS

Office Action dated May 8, 2009, issued on the Chinese patent application No. 200810002920.1 and the English translation thereof.

* cited by examiner

*Primary Examiner* — Khanh Nguyen
*Assistant Examiner* — John Blades
(74) *Attorney, Agent, or Firm* — Edwards Angell Palmer & Dodge LLP

(57) ABSTRACT

A wire-gathering device to position a plurality of electrical wires without swing to the center of a rotating drum regardless of size of outer diameters of a bundle of the electrical wires by means of a simple configuration. The wire-gathering device includes the rotating drum having a notch for allowing insertion of the wires and an adhesive tape together and a band disposed in the notch for resiliently supporting and gathering the wires with a curved surface thereof. The band is resilient. The wire-gathering device further includes a slider slidably disposed in the notch and fixing the band, wherein the slider is urged toward an opening of the notch with a resilient member.

4 Claims, 5 Drawing Sheets

WIRE-GATHERING DEVICE, APPARATUS AND METHOD OF WINDING TAPE UTILIZING SAME

BACKGROUND OF THE INVENTION

1. Field of the Invention

The present invention relates to a wire-gathering device for positioning wires such as a plurality of electrical wires at the center of a rotating drum when winding the electrical wires with an adhesive tape. The present invention also relates to an apparatus and a method of winding the adhesive tape around the wires utilizing the wire-gathering device.

2. Description of the Related Art

FIG. 6 shows a conventional tape-winding apparatus having a conventional electrical wire-gathering device (JP, H07-215599, A and especially FIG. 9).

The tape-winding apparatus 65 is a handy type and includes a rotating drum 67 having a notch 66 to accept a plurality of electrical wires (not shown), a positioning plate 68 as an electrical wire-gathering device to slidably adjust an inner width of the notch 67, a swing plate 69 to support the positioning plate 68 with a roller, and a tape reel 71 disposed on an axle 70 of the swing plate 69 and wound with an adhesive tape.

The positioning plate 68 includes an L-shaped electrical wire support surface 68*a*, which forms a rectangular shaped wire support face with a support surface 66*a* of the notch 66. The electrical wires are inserted into the notch 66 and the positioning plate 68 is moved to abut an outer periphery of the electrical wires. The rotating drum 67 is then rotated with a motor to wind the outer periphery of the electrical wires with the adhesive tape.

JP, H07-215599, A also discloses that a tape-winding apparatus includes a pair of positioning plates (not shown) symmetrically positioned each having a circular support surface, the positioning plates being symmetrically slid to support the electrical wires at the center of a rotating drum.

FIGS. 7A and 7B show a conventional tape-winding apparatus (JP, H09-183413, A) having a conventional electrical wire-gathering device.

The tape-winding apparatus 50 is a stationary type and includes a rotating drum 57 having a notch 61 to accept a plurality of electrical wires in a bundle, a pair of brushes 62 as an electrical gathering device disposed in the notch 61, a motor to drive the rotating drum 57 via a gear 58, rollers 52, 55 and a guide plate 56 to supply an adhesive tape made of a synthetic resin to a side of an opening 61*a* of the notch 61, a gear 53 to drive the roller 52, and a movable blade 59 and a stationary blade 60 to cut the adhesive tape 54 short of the rotating drum 57.

The electrical wires 63 and the adhesive tape 54 are both inserted between the brushes 62 and the adhesive tape 54 is wound around the electrical wires 63 in a direction indicated by an arrow to gather the electrical wires 63.

FIGS. 8A and 8B are a conventional handy type tape-winding apparatus including an electrical wire-gathering device.

The electrical wire-gathering device includes a rotating drum 73 having a notch 74, in which a rectangular slider 75 is supported back-and-forth with a coil spring 76.

At beginning of winding an adhesive tape 78, a plurality of electrical wires 77 are loosely positioned approximately at the center of the rotating drum 73 with a slider 75 as shown in FIG. 8A. An end portion 78*a* of the adhesive tape 78 bonds a return portion 78*b*. As shown in FIG. 8B, the rotating drum 73 rotates about one revolution and the adhesive tape 78 is thus wound around the electrical wires 77 as a primary winding. Further rotation of the rotating drum 73 in the same direction enables a plurality of windings of the adhesive tape 78 around the electrical wires 77 as a secondary winding (not shown).

The conventional electrical wire-gathering devices utilizing the positioning plate 68 or the like (not shown) have a disadvantage to move to and abut the positioning plate 68 the outer surface of the electrical wires for gathering, resulting in a tolerance work and complicated structure.

The conventional electrical wire-gathering device of FIG. 7B encounters problems for outer diameters of the electrical wires 63. When the diameter of the bundled electrical wires is much smaller than the gap between the pair of brushes, the electrical wires 63 swing between the brushes 62, and when the diameter thereof is much larger than the gap between the pair of brushes, the brushes 62 get crushed.

The conventional electrical wire-gathering device of FIGS. 8A-8C has a disadvantage such that the electrical wires 77 wound in the primary winding move along a receiving surface 75*a* in a lateral direction of the notch 74 when the rotating drum 73 rotates approximately by one revolution as shown in FIG. 8C. A further rotation of the rotating drum 73 swings the electrical wires 77, resulting in losing its own looks at the secondary winding.

These problems encounter winding of a corrugated tube (protection tube of harness) covering the electrical wires 63 and other wires besides the electrical wires 63.

SUMMARY OF THE INVENTION

An object of the present invention is to provide a wire-gathering device to position a plurality of wires such as electrical wires without swing at the center of a rotating drum with ease and with a simple configuration regardless of size of an outer diameter of the bundled wires, and also provide a tape-winding apparatus and a method of winding the tape around the wires utilizing the wire-gathering device.

According to a first aspect of the present invention, a wire-gathering device includes a rotating drum having a notch for allowing insertion of a plurality of wires and an adhesive tape together; and a band disposed in the notch for resiliently supporting and gathering the wires with a curved surface thereof.

Preferably, the band is resilient.

Preferably, the wire-gathering device further includes a slider slidably disposed in the notch and fixing the band, wherein the slider is urged toward an opening of the notch with a resilient member.

According to a second aspect of the present invention, a tape-winding apparatus includes the wire-gathering device, wherein the wires are wound around with the adhesive tape with the rotating drum when the wires are positioned at the center of the rotating drum along the band.

According to a third aspect of the present invention, a method of winding the adhesive tape around the wires utilizes the wire-gathering device, wherein the wires are wound around with the adhesive tape with the rotating drum when the wires are positioned at the center of the rotating drum along the band.

DETAILED DESCRIPTION OF THE PREFERRED EMBODIMENTS

Figure 1A:
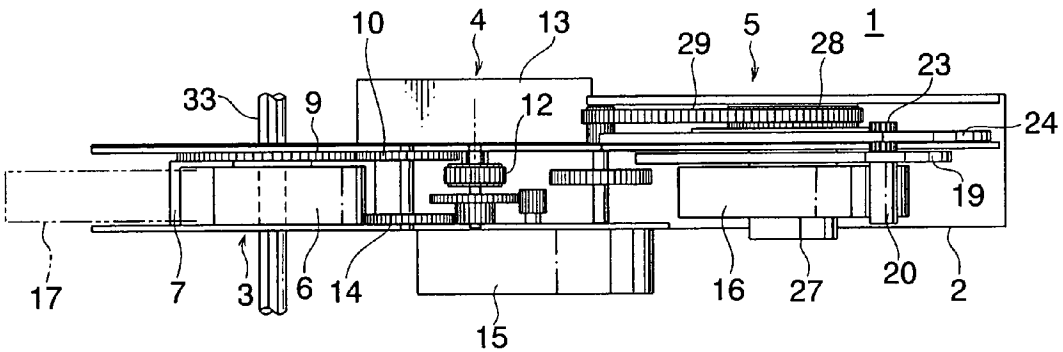
FIG. 1A is a plan view of a tape-winding apparatus including an electrical wire-gathering device according to the present invention.
Figure 1B:
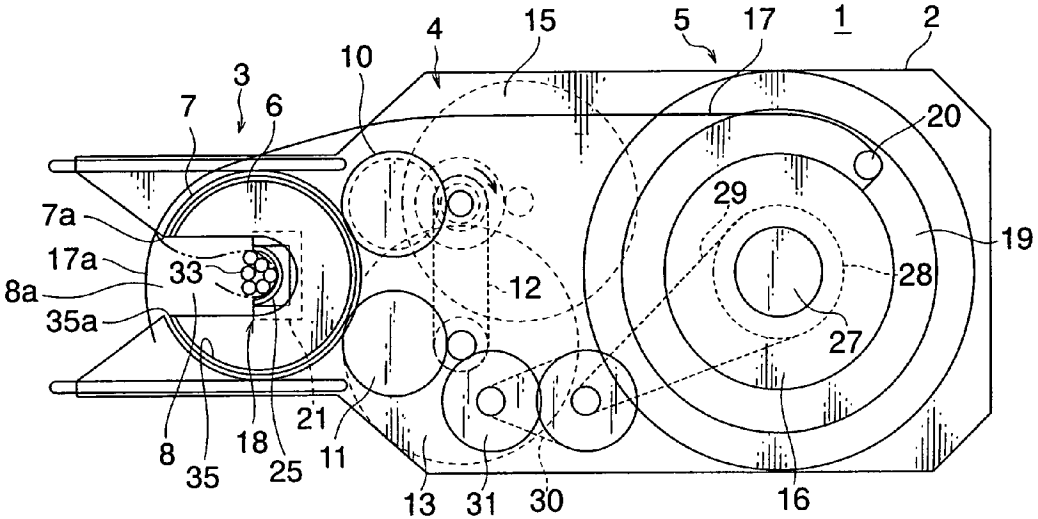
FIG. 1B a front view of the tape-winding apparatus of FIG. 1A.
Figure 2A:
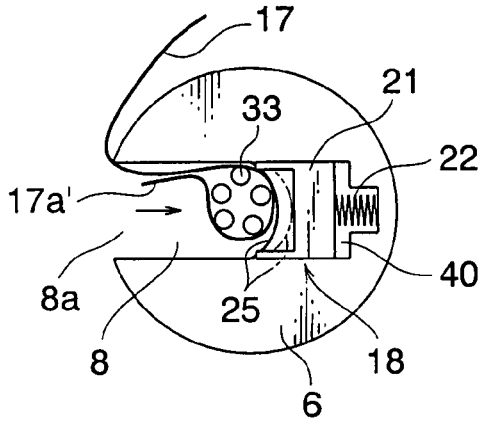
FIG. 2A is a front view showing setting a plurality of electrical wires in bundle in a rotating drum of the electrical wire-gathering device.
Figure 2B:
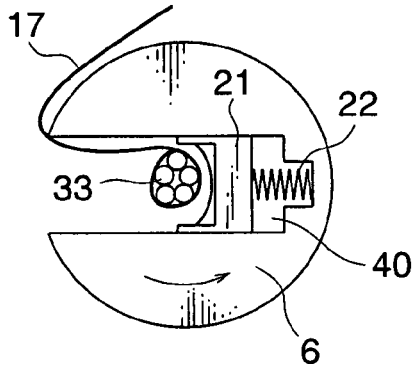
FIG. 2B is a front view showing a primary winding of an adhesive tape around the electrical wires.

FIGS. 1A and 1B are an embodiment of a tape-winding apparatus having a wire-gathering device of the present invention. FIGS. 2A and 2B are an embodiment of a method of winding a tape with the tape-winding apparatus utilizing the wire-gathering device.

Referring to FIGS. 1A and 1B, the tape-winding apparatus 1 includes a rotating drum 6 as a tape-winding portion 3 at a front side of a case 2, a driving portion 4 at a middle portion of the case 2, and an adhesive tape-supplying device 5 at a rear side of the case 2. The tape-winding apparatus 1 is a stationary type and is adapted to a handy type if it is reduced in size and weight.

The tape-winding portion 3 includes the rotating drum 6 having a notch 8, a stationary annular belt 35 disposed around an outer surface of the rotating drum 6, a circular shaped tape-cutting belt 7 disposed back-and-forth around an outer surface of the annular belt 35, and an electrical wire chuck (not shown) disposed on one or both sides of the center of the rotating drum 6.

A tape pushing portion 7*a* is disposed at a front end of the cutting belt 7 and a stationary blade 35*a* is disposed at a front end of the annular belt 35. The tape pushing portion 7*a* and the stationary blade 35*a* are opposite to each other with respect to the notch 8. The cutting belt 7 is driven with a motor and moved down along an opening 8*a* of the notch 8. The tape pushing portion 7*a* is pushed down to cut an adhesive tape 17 with the stationary blade 35*a*.

The adhesive tape 17 is supplied with an adhesive tape reel 16 thorough a guide plate and a guide roller (not shown) to the rotating drum 6 and trails down along the opening 8*a* of the notch 8. A trailed portion 17*a* of the adhesive tape 17 is inserted into the notch 8 together with a plurality of electrical wires (wires) 33 as indicated by a dot-dashed line in FIG. 1B.

Referring to FIG. 2A, a slider 21 made of a synthetic resin is disposed inside of the notch 8 of the rotating drum 6 and slidable along a longitudinal direction of the notch 8. The slider 21 is urged by a compression coil spring (resilient member) 22 toward the opening 8*a*.

The notch 8 extends longer than the conventional one and has an extended space 40 to permit sliding of the slider 21. The compression coil spring 22 is disposed between the slider 21 and a rear end of the notch 8. Both ends of the compression spring 22 are fixed or abut the associated surfaces. The notch 8 is formed along a radial direction of the rotating drum 6 and passes the center of the rotating drum 6. The center line of the notch 8 crosses the center of the rotating drum 6.

Figure 3A:
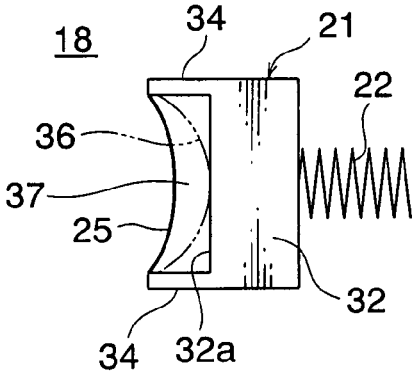
FIG. 3A is a front view showing the electrical wire-gathering device in an initial state.

Referring to FIG. 3A, the slider 21 includes a curved rubber band 25 to accept the electrical wires 33 and the adhesive tape 17 together. The slider 21, the coil spring 22, and the rubber band 25 configure an electrical wire-gathering device 18.

The slider 21 includes a rectangular block body 32 and opposed parallel walls 34 extending forwardly from both end portions of the block body 32. The opposed walls 34 fix the respective ends of the rubber band 25.

The upper and lower walls 34 and a front end surface 32*a* of the block body 32 define a rectangular space 37 (deflection receiving chamber) to accept deflection of the rubber band 25. A curved surface 36 depicted by a dot-dashed line can replace the front end surface 32*a* and is connected to the respective walls 34. The curved surface 36 properly accepts the maximum deflection of the rubber band 25 and assists gathering of the electrical wires as shown in FIG. 3B.

Figure 3B:
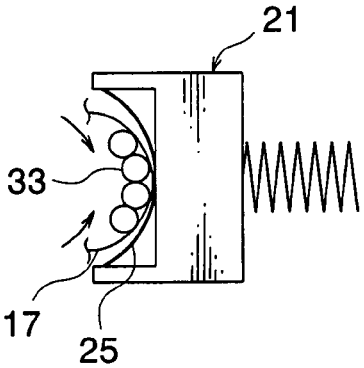
FIG. 3B is a front view showing the electrical wire-gathering device gathering the electrical wires.

Movement of the slider 21 and retraction of the rubber band 25 are capable of accepting outer diameters of various sizes of the bundled electrical wires 33, and gather the electrical wires 33 inside the adhesive tape 17 in a direction indicated by an arrow in FIG. 3B. The curved surface of the rubber band 25 serves as a path to guide the electrical wires 33 toward the center of the rotating drum 6. The rubber band 25 in FIG. 3B expands to the right more than the rubber band 25 in FIG. 3A, resulting in a smaller diameter.

It is preferable that the rubber band 25 has the curved surface at the initial state. The stretched rubber band is also capable of gathering the electrical wires 33 since both ends thereof are fixed. Insertion of the electrical wires 33 deflects the rubber band 25 to gather the electrical wires 33 along the curved surface.

A large number of the electrical wires 33 or the bundle of the electrical wires each having a large diameter pushes more the coil spring 22.

It is preferable that the rubber band 25 of the slider 21 with urge of the coil spring 22 is positioned at the center of the rotating drum 6 or ahead, i.e. between the center and the opening 8*a*, prior to inserting the electrical wires 33. Force-insertion of the electrical wires 33 and the adhesive tape 17 moves backwardly the slider 21 and compresses the coil spring 22. "Front side" in the specification designates the left side of FIGS. 1A and 1B where the opening 8*a* of the notch 8 is initially positioned.

The electrical wires 33 loosely bound are inserted into the notch 8 together with the adhesive tape 17 in a direction indicated by an arrow of FIG. 2A. The electrical wires 33 push backwardly strongly the rubber band 25 as indicated by a dash-dotted line. The electrical wires 33 are gathered toward the center of a height direction along the curved rubber band 25. The coil spring 22 is compressed and the slider 21 is moved backwardly. Resilience of the rubber band 25 and the coil spring 22 position the electrical wires 33 to the center of the rotating drum 6. The electrical wires 33 may be held by a worker or with the chucks at both right and left sides of the rotating drum 6.

It is preferable that a force to deflect the rubber band 25 is smaller than a force of the coil spring 22 so that the coil spring 22 can be compressed and the slider 21 can be moved backwardly when the rubber band 25 is largely deflected backwardly or abuts the front end surface 32*a* of the block body 32.

An end portion 17*a*' of the adhesive tape 17 bonds to an opposite adhesive surface positioned above. The rotating drum 6 is then rotated by about one or half rotation in a direction indicated by an arrow (counterclockwise direction) in FIG. 2B to wind the electrical wires 33 with the adhesive tape 17 as a primary winding. 2B. The electrical wires 33 of FIG. 2B are intimately gathered together compared with the electrical wires 33 of FIG. 2A, resulting in a smaller diameter of the bundled electrical wires 33. The slider 21 accordingly pushes forwardly the electrical wires 33 with resilience of the coil spring 22 to position the electrical wires 33 at the center of the rotating drum 6.

Figure 4A:
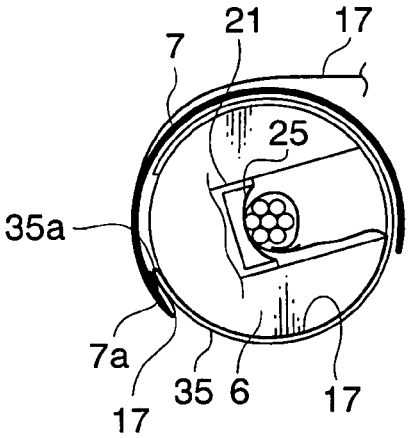
FIG. 4A is a front view showing that the adhesive tape is cut.
Figure 4B:
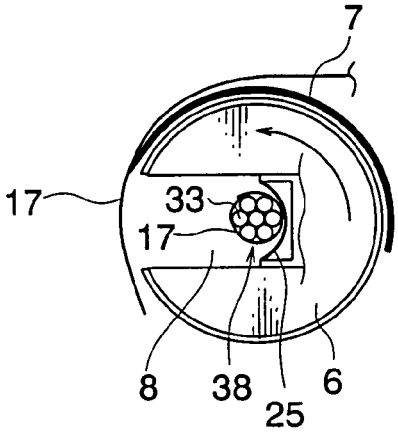
FIG. 4B is a front view showing the rotating drum winding the adhesive tape around the electrical wires as a secondary winding.

The cutting belt 7 is rotated counterclockwise to cut the adhesive tape 17 with the stationary blade 35*a* and the tape pushing portion 7*a*. FIG. 4A shows that the rotating drum 6 is further rotated by half rotation from FIG. 2B. A further rotation of the rotating drum 6 winds the adhesive tape 17 around the electrical wires 33 as a secondary winding. The bundled electrical wires 33 are always positioned at the center of the rotating drum 6 by means of the rubber band 25 and the slider 21. The tape pushing portion 7*a* can be replaced with a movable blade and the stationary blade 35*a* can be replaced with the tape pushing portion.

The bundled electrical wires 33 are always positioned at the center of the rotating drum 6 and swing thereof is thus avoided. The electrical wires 33 are thus wound smoothly and assuredly with the adhesive tape 17 by a specified length without crease of the adhesive tape 17. The crease of the adhesive tape 17 is caused by cavities between the electrical wires 33. The positioning of the electrical wires 33 to the center of the rotating drum 6 as shown in FIG. 2A and the gathering of the electrical wire 33 to the center of the curved rubber band 25 as shown in FIG. 3B avoid the cavities and prevent generating creases.

The driving portion 4 of the tape-winding apparatus 1 includes devices to drive the rotating drum 6, the cutting belt 7, and an adhesive tape-supplying device 5. The driving portion 4 described below is purely exemplary and is designed to modify if necessary.

The rotating drum 6 is integral with a gear 9 engaging with a pair of driving gears 10, 11. The gears 10, 11 are driven in the a same direction with a motor 13 via a belt 12. One of the gears 10, 11 always drives to rotate counterclockwise the rotating drum 6 regardless of the position of the notch 8 of the rotating drum 6.

The cutting belt 7 is integral with a gear (a circular rack, not shown) engaging with a gear 14. The gear 14 is driven with a motor 15 by a counterclockwise direction of 90 degrees. The motors 13 and 15 are fixed to the case 2.

The adhesive tape-supplying device 5 includes an axle 27 of a large diameter to hold the adhesive tape reel 16, a central axle (not shown) passing through the axle 27 to rotatably support the adhesive tape reel 16, a circular disk 19, an one way bearing 20 projecting from the rotating drum 19, a plurality of guide rollers (not shown) with a small diameter, a small gear 23 disposed on a axial portion of the one way bearing 20, and an internal gear (fixed gear) 24 with a large diameter, engaging the small gear 23.

The electrical wire-gathering device 18 of FIGS. 2A, B and 3A, 3B are also adapted to a handy type or a stationary type of the tape-winding apparatus 1.

In FIGS. 3A and 3B, the pair of walls 34 has high rigidity to deflect the rubber band 25. It is appreciated that the pair of walls 34 can be flexible and the rubber band 25 can be replaced with a flexible curved resin band 25. In this case, the electrical wires 33 push the resin band 25 as in FIG. 2A and are gathered to the center of the rotating drum 6 along the curved resin band 25. The pair of walls 34 thus inwardly deflect and allow deflection of the resin band 25 with a small flexion.

The coil spring 22 to urge the slider 21 can be replaced with a resilient member such as a leaf spring, a helical spring, or a rubber.

It is appreciated that the rubber band 25 is disposed in the notch 8 of the rotating drum 6 without the slider 21. Although this configuration loses the large absorbance of position displacement of the slider 21, the rubber band 26 absorbs the small position displacement and gathers the electrical wires 33 to the center of the rotating drum 6 along the curved surface thereof.

Figure 5:
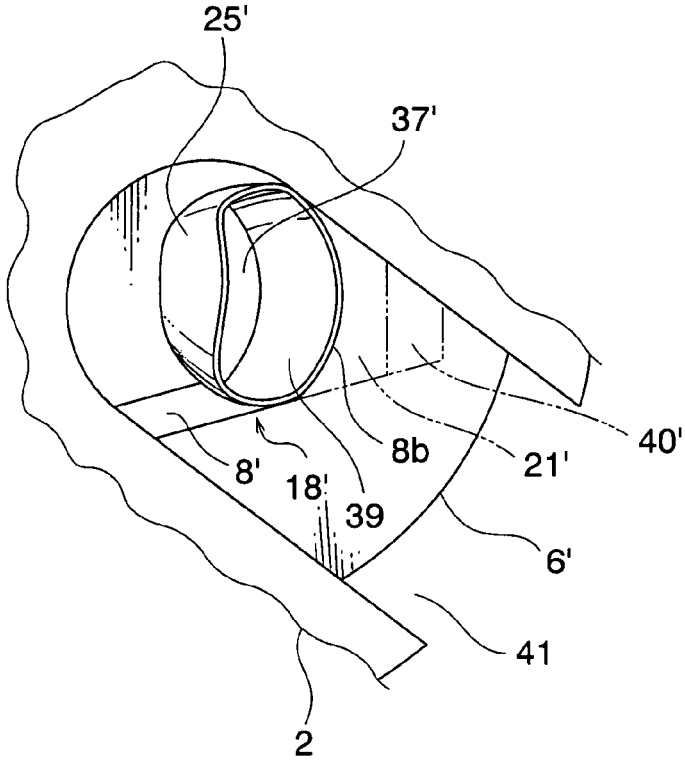
FIG. 5 is a perspective view of another embodiment of the electrical wire-gathering device of the present invention.
Figure 6:
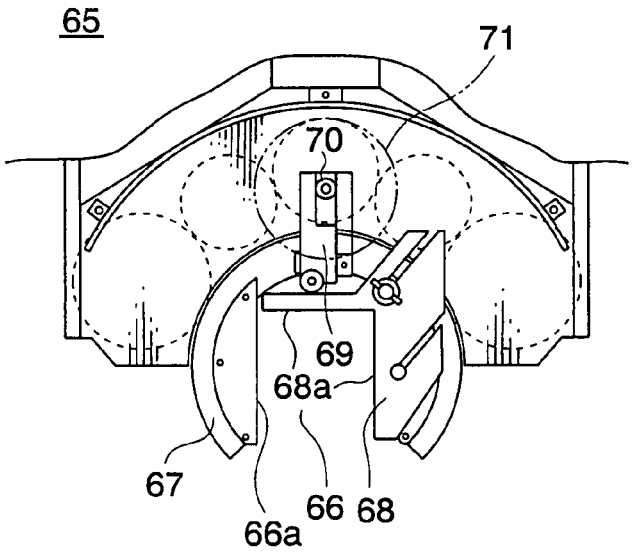
FIG. 6 PRIOR ART
FIG. 6 is a plan view of a conventional tape-winding apparatus having a conventional electrical wire-gathering device.
Figure 7A:
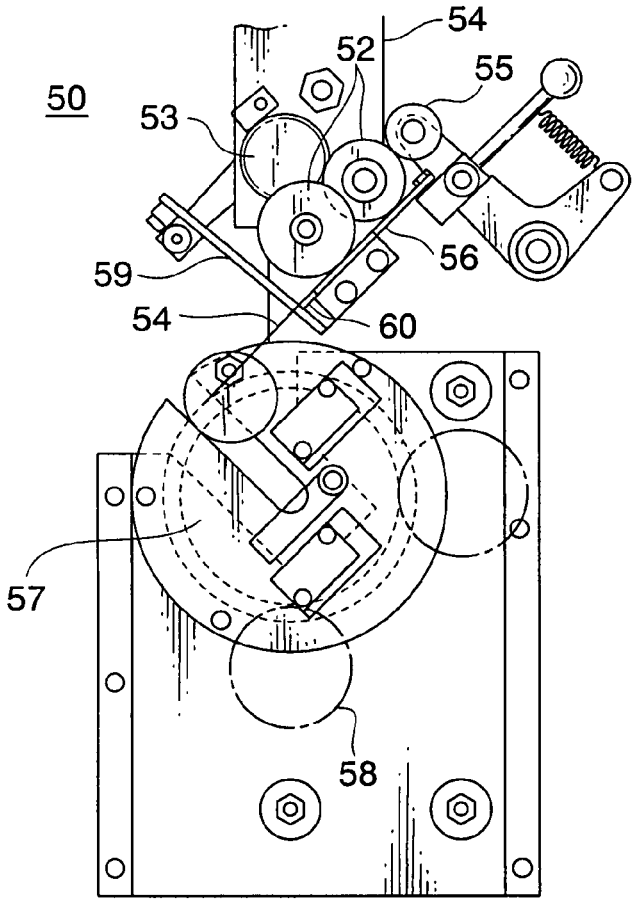
FIG. 7A PRIOR ART
FIG. 7A is a plan view of a conventional tape-winding apparatus having a conventional electrical wire-gathering device.
Figure 7B:
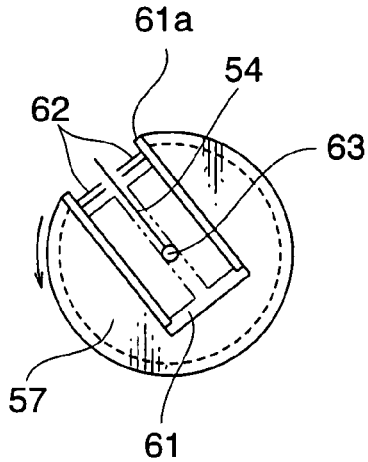
FIG. 7B PRIOR ART
FIG. 7B is a front view of the electrical wire-gathering device of FIG. 7A.
Figure 8A:
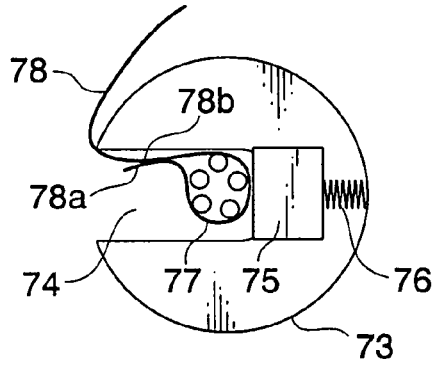
FIG. 8A PRIOR ART
FIG. 8A is a plan view showing a first step of winding an adhesive tape with a conventional electrical wire-gathering device.
Figure 8B:
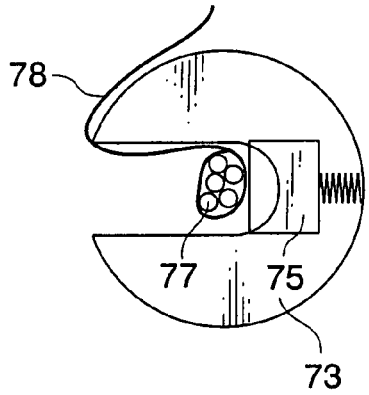
FIG. 8B PRIOR ART
FIG. 8B is a plan view showing a second step of winding the adhesive tape with the conventional electrical wire-gathering device.
Figure 8C:
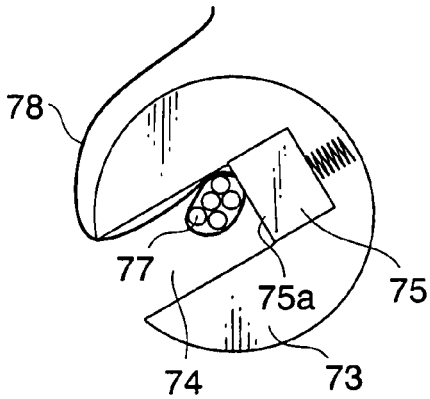
FIG. 8C PRIOR ART
FIG. 8C is a plan view showing a third step of winding the adhesive tape with the conventional electrical wire-gathering device.

FIG. 5 shows another embodiment of the wire-gathering device of the present invention. Portions other than the wire-gathering device are same as the tape-winding apparatus 1 of FIG. 1.

The wire-gathering device 18' includes a rubber band 25' integrally fixed to an end (rear end) of a notch 8' of a rotating drum 6'. The rubber band 25' is fixed with roll-in or adhesion to both ends of a board member 39 which is fixed to an end surface 8*b* of the notch 8'. The board member 39 and the rubber band 25' form a deflection receiving chamber 37'.

A curved surface of the board member 39 functions same as the curved surface of the slider 21 of FIG. 3B. The rubber band 25' is slightly deflected initially. Force-press of the electrical wires 33 deflects the rubber band 25' and positions the electrical wires 33 at the center of the rotating drum 6' along the curved surface of the rubber band 25'.

It is appreciated that a ring-shaped rubber band (not shown) can be utilized and a part of a circumferential wall thereof is fixed to the end surface 8*b* of the notch 8'. A slider 21' can be disposed on the rotating drum 6' indicated by a dot-dashed line in FIG. 5. The slider 21' is urged toward an opening of the notch 8' with a resilient member such as the coil spring 22 in an extended space 40'. The rubber band 25' is attached to slider 21'.

When the slider 21' is not disposed, a front end surface of the rubber band 25' in a free state is positioned nearly at the center or a little close to the opening of the notch 8' of the rotating drum 6' so that the force-insertion of the bundled electrical wires 33 deflects the rubber band 25' and gathers the electrical wires 33 toward the center of the rotating drum 6'. When the slider 21' is disposed, it is preferable to set a suitable combination of elastic forces of the rubber band 25' and coil spring 22 so that the bundled electrical wires 33 deflect backwardly the rubber band 25' and push back the slider 21'.

FIG. 5 shows that a notch 41 of the case 2, which covers the rotating drum 6', is rotated about half rotation with respect to the rotating drum 6'. The electrical wires 33 are inserted into the notch 8' when the notches 41 and 8' are aligned.

The technical features of the present invention are summarized below. The flexible curved surface has more advantage than the conventional non-flexible curved surface. The combined use of the band and the slider can limit the amount of deflection and the length of the band. The configuration of the rotating drum is simplified, resulting in low cost manufacturing by virtue of the band. The simple operation such as deflection of the band achieves positioning of the wires. The outer diameter of the bundled wires is limited by the inner width of the notch regardless of size and number of wires in the bundled wires.

The above embodiment is adapted to the electrical wires 33 but also adapted to hose of small diameter or non-power supply cable.

What is claimed is:

1. A wire-gathering device comprising:

a rotating drum having a notch for allowing insertion of a plurality of wires and an adhesive tape together;

a slider slidably disposed within the notch, said slider including a rectangular block body; and a resilient band having a curved surface at its initial state disposed in the notch for resiliently supporting and gathering the wires, wherein said resilient band has respective ends attached to opposed parallel walls of said block body.

2. The wire-gathering device as claimed in claim 1, wherein the slider is urged toward an opening of the notch with a resilient member.

3. A tape-winding apparatus having the wire-gathering device as claimed in claim 1, wherein the wires are wound around with the adhesive tape with the rotating drum when the wires are positioned at the center of the rotating drum along the band.

4. A method of winding the adhesive tape around the wires utilizing the wire-gathering device as claimed in claim 1, wherein the wires are wound around with the adhesive tape with the rotating drum when the wires are positioned at the center of the rotating drum along the band.

* * * * *